United States Patent [19]

DeVries

[11] Patent Number: 4,967,931

[45] Date of Patent: Nov. 6, 1990

[54] BOTTOM-UP FILLER

[75] Inventor: Cornnelis L. DeVries, Spijkenisse, Netherlands

[73] Assignee: Lever Brothers Company, New York, N.Y.

[21] Appl. No.: 322,034

[22] Filed: Mar. 10, 1989

[30] Foreign Application Priority Data

Mar. 17, 1988 [GB] United Kingdom ..... 8806369

[51] Int. Cl.[5] ..... B67B 7/00; G01F 11/10; B67C 3/26

[52] U.S. Cl. ..... 222/1; 222/287; 222/320; 222/355; 222/361; 222/447; 222/448; 222/571; 141/117; 141/260

[58] Field of Search ..... 222/571, 319, 320, 255, 222/275, 276, 386, 445, 446, 447, 448, 451, 453, 524, 355, 361, 108, 287, 1; 417/511, 518, 259; 141/116, 117, 258, 260, 261

[56] References Cited

U.S. PATENT DOCUMENTS

| | | | |
|---|---|---|---|
| 2,413,916 | 1/1947 | Hallead . | |
| 2,978,149 | 4/1961 | Rosen . | |
| 3,097,671 | 7/1963 | Bonetti et al. | 141/116 |
| 3,817,300 | 6/1974 | Donnett . | |
| 3,979,172 | 9/1976 | Sogo et al. | 222/571 |
| 4,014,629 | 3/1977 | Elsworth | 417/259 |
| 4,264,806 | 3/1981 | Elsworth . | |
| 4,341,329 | 7/1982 | Kuemmerer | 222/275 |
| 4,479,758 | 10/1984 | Hersom | 417/518 X |
| 4,767,031 | 8/1988 | Proepper | 222/276 X |

FOREIGN PATENT DOCUMENTS

| | | | |
|---|---|---|---|
| 142204 | 5/1985 | European Pat. Off. . | |
| 160210 | 10/1979 | Netherlands | 141/261 |
| 10508 | 3/1911 | United Kingdom . | |
| 213337 | 3/1924 | United Kingdom . | |
| 458709 | 12/1936 | United Kingdom . | |
| 749691 | 5/1956 | United Kingdom . | |
| 798608 | 7/1958 | United Kingdom . | |
| 1335007 | 10/1973 | United Kingdom . | |
| 1379697 | 1/1975 | United Kingdom . | |

*Primary Examiner*—Andres Kashnikow
*Assistant Examiner*—Gregory L. Huson
*Attorney, Agent, or Firm*—Gerard J. McGowan, Jr.

[57] ABSTRACT

Apparatus for volumetric dosing of viscous products comprising a dispensing outlet connected to apparatus for substantially vertically moving the outlet, a supply conduit, a valve for the supply conduit, a dispensing valve and a dosing chamber. The dispensing outlet constituting the lower end of the dosing chamber. Preferably the apparatus comprises a suck back feature for sucking back product to prevent after dripping.

8 Claims, 2 Drawing Sheets

BOTTOM-UP FILLER

BACKGROUND AND SUMMARY OF THE INVENTION

The invention relates to an apparatus for the volumetric dosing of viscous products. More specific the invention relates to an apparatus for the volumetric dosing of aerated and therefore compressible, viscous products such as ice-cream.

In the dosing of viscous products it is often desired to use the so-called bottom-up filling method in order to avoid inclusion of air pockets. This method involves the upwards movement of the dispensing outlet during the dispensing period, thereby maintaining a relatively small distance between the product level in the container to be filled and the dispensing outlet.

Existing bottom-up fillers, especially when used for filling ice-cream, are inflexible in that the volume of the product to be dispensed can hardly be varied within a short time. Additionally the dosing accuracy is generally rather low and sensitive to the pressure in the supply conduit. Furthermore the dead volume of these devices is rather high, which also increases inaccuracy.

It is an object of the present invention to provide an apparatus for the accurate volumetric dosing of viscous products of the bottom-up filler type, which is easy to operate, which is flexible and which is less sensitive to the compressibility of the product, and which avoids the effects of post-expansion in the dispensing tube due to its dead volume.

It has been found that such a filling device advantageously comprises a vertically moveable dispensing outlet and a dosing chamber, wherein the moveable part of the dispensing outlet constitutes the lower end of the dosing chamber. An apparatus according to the invention is therefore characterized by a supply conduit, a valve for said supply conduit, a dosing chamber, a dispensing outlet which constitutes the lower end of the dosing chamber, a valve for said outlet and means for substantially vertically moving said outlet.

Preferably the dispensing device comprises a housing for substantially vertically guiding the movement of the dispensing outlet. This housing can also constitute the side wall of the dosing chamber. Preferably the housing also guides the movement of those parts which constitutes the supply valve and/or the dispensing valve.

In an advantageous embodiment of a device according to the invention there are provided means for sucking back a part of the product after dispensing to prevent dripping and trailing of the product during withdrawal of the dispensing outlet of the product during non-dispensing. An example of such a suction device is disclosed in EP No. 142 204.

Preferably the suction means are constituted by the parts which also constitute the supply valve and/or the upper wall of the dosing chamber.

The invention also provides a method for the dosing of viscous products using a dispensing device comprising a supply conduit, a supply valve, a dosing chamber, a dispensing outlet which constitutes the lower end of the dosing chamber, a dispensing valve and means for substantially vertical moving said outlet, comprising the steps of;

(a) downwardly moving the dispensing outlet while the supply valve is open and the dispensing valve is closed, thereby increasing the volume of the dosing chamber and filling the dosing chamber with viscous product (b) closing the supply valve (c) opening the dispensing valve (d) upwardly moving the dispensing outlet, thereby decreasing the volume of the dosing chamber and ejecting the viscous product from the dosing chamber (e) closing the dispensing valve, and (f) opening the supply valve.

Preferably the closing of the supply valve under (b) is effected by downwardly moving the parts which constitute the upper end of the dosing chamber. This downward movement is preferably accompanied by a further equal downward movement of the dispensing outlet to ensure a constant volume of the dosing chamber to avoid compression of its contents.

The upward movement of the dispensing outlet may be accompanied by an upward or downward movement of the upper end of the dosing chamber, as long as the desired changed volume of the dosing chamber is effected. An upward movement of the upper end of the dosing chamber will generally reduce the dispensing rate, a downward movement will increase the dispensing rate.

Between steps (d) and (e) it is also possible to effect an upward movement of the upper end of the dosing chamber in relation to the dispensing outlet while the dispensing valve is still open, thereby effecting a sucking back of material from the dispensing outlet into the dosing chamber and the supply conduit.

DETAILED DESCRIPTION OF THE INVENTION

Figure 1:
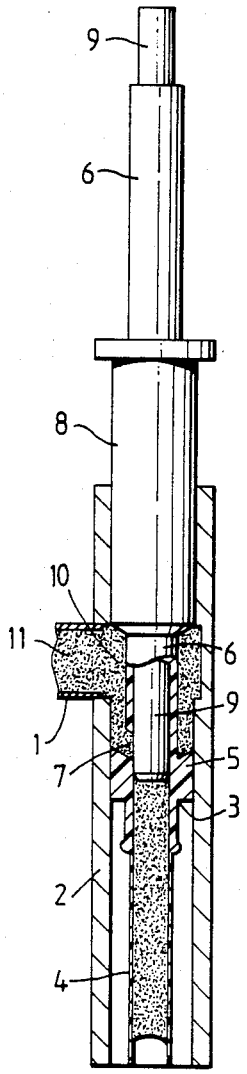
FIGS. 1–6 are elevational views partially in cross section of the apparatus of the invention in different positions of operation.

The invention will be illustrated by means of the accompanying drawings, the figures of which show a preferred embodiment of an apparatus according to the invention comprising a supply conduit 1; a housing 2 connected to this supply conduit; a dispensing outlet 3 which is vertically slidable in housing 2 and which is composed of a flexible dispensing tube 4; a rigid carrier portion 5 and a hollow cylindrical tube 6 comprising an opening 7; a ring piston 8 constituting the supply valve, which piston is also slidable in housing 2 and which is constituted by a hollow cylindrical member which closely fits into the housing 2 and also closely fits around the hollow cylindrical tube 6; a needle 9 which is vertically moveable in the tube 6 thus constituting a dispensing valve for opening 7; and a dosing chamber 10.

FIG. 1 shows the starting position of the dispensing cycle in which the ring piston 8 is in the upper position thus ensuring that the supply valve is open, allowing the inflow of material 11 through the supply conduit 1 into the dosing chamber 10. The dispensing outlet 3 is in its highest position, the needle 9 closes opening 7 thus preventing transfer of material from chamber 10 into the dispensing outlet 3.

Figure 2:
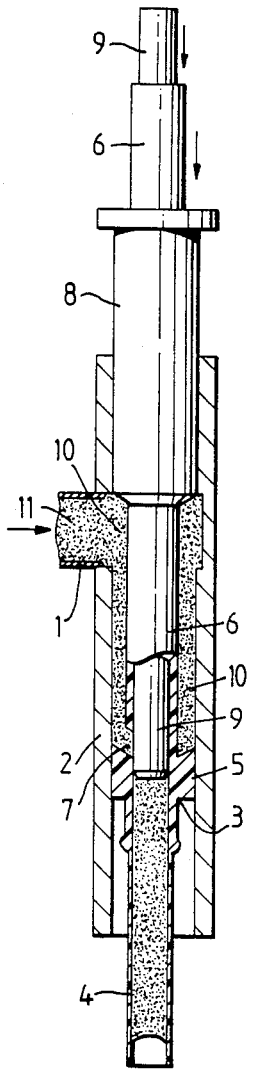

FIG. 2 shows the position after simultaneous downward movement of the needle 9 and the dispensing outlet 3 whereby the volume of the dosing chamber 10 is increased and more material is transferred from the supply conduit 1 into the dosing chamber 10.

Figure 3:
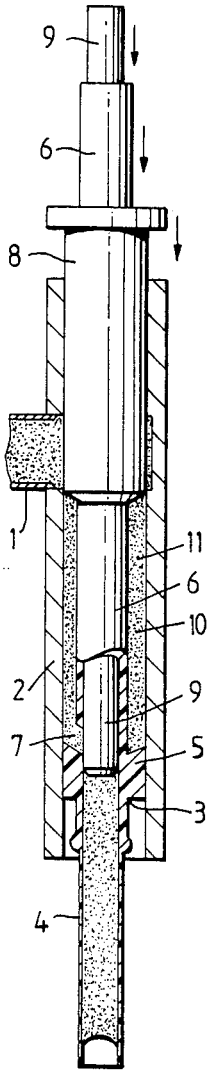

FIG. 3 shows the position after a simultaneous downwards movement of the needle 9, the dispensing outlet 3 and the ring piston 8 whereby the volume of the dosing chamber 10 is kept constant and the supply valve is closed thus preventing further entrance of material from the supply conduit 1 into the dosing chamber 10.

Figure 4:
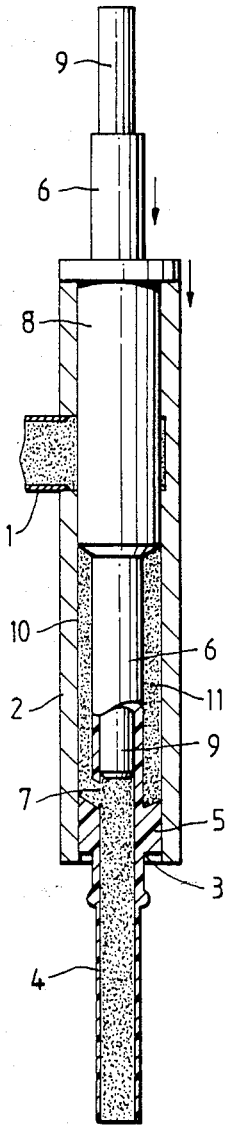

FIG. 4 shows the position after a simultaneous downward movement of the ring piston 8 and the dispensing outlet 3, whereby the volume of the dosing chamber is kept constant and the opening 7 is no longer blocked by needle 9 thus allowing the starting of dispensing of material from dosing chamber 10 through dispensing outlet 3.

Figure 5:
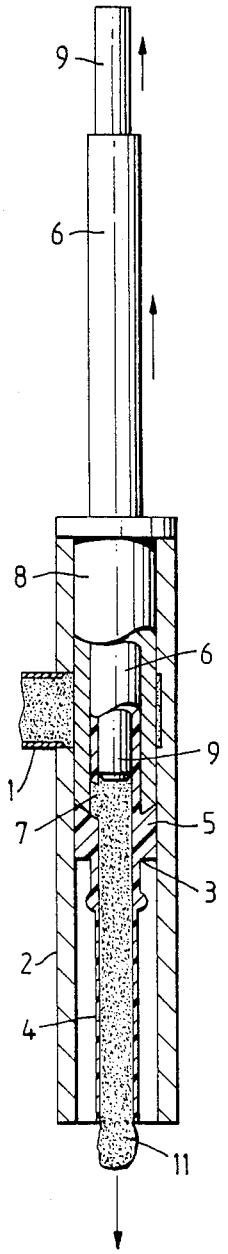

FIG. 5 shows the position after simultaneous upward movement of the needle 9 and the dispensing outlet 3, thus effecting a dispensing of material and by simultaneous upward moving the dispensing tube 4. During this upward movement of the needle 9 and the outlet 3 the movement of the ring piston 8 is either upward, nil or downward depending on the selected operational parameters as long as the volume of the dosing chamber is reduced. In the position of FIG. 5 the volume of the dosing chamber is reduced to zero although the opening 7 is still not blocked by needle 9.

Figure 6:
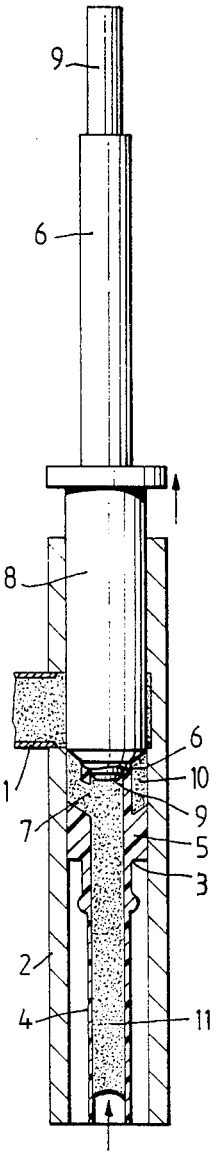

FIG. 6 shows the position after a small upwards movement of ring piston 8 without opening the supply valve, thereby effecting a suck back of material from the dispensing outlet through opening 7 into the dosing chamber 10.

The position of FIG. 1 is reached again from the position of FIG. 6 by downward movement of needle 9, thereby closing opening 7 followed by upward movements of ring piston 8, thereby opening the supply valve, this upward movement can be accompanied by a further upward movement of the dispensing outlet.

The movement of all parts is effected by hydraulic means (not visible) which are computer or computer-like (PLC) controlled.

The (variable) positions at the end of each stage which are the start position for the next stage easily can be changed by the operator, e.g. by means of thumbwheels key-boards and the like, thus allowing the flexible operation especially under changing conditions.

The rate at which the parts are moved with respect of each other will equally be varied by the computer controlled system according to the circumstances as determined by the chosen operational valves.

For the filling of containers having a cross-section which varies in size with the height, it may be an advantage to vary the ratio of the upward speed of the dispensing outlet 3 and the speed of the ring piston 8 - related to the dispensing outlet 3 in relation to the variation of the cross-section thus allowing a small dispensing at small cross-sections and an increased dispensing at larger cross-sections.

The desired speed of operation can easily be incorporated in the computer program.

In order to increase the accuracy of the dosing the pressure in the supply conduit is preferably maintained constant thereby avoiding differences because of different compressions.

The possibility of independently controlling the positions of all individual parts renders this embodiment of a filling device according to the invention extremely flexible.

The coaxial configuration of parts allows the use of light materials and only requires a small amount of space, thus allowing the mounting of several of these devices in a row to effect the simultaneous filling of a series of containers.

The location of the dosing chamber immediately on top of the dispensing outlet creates only a very small dead volume in the device. This gives raise to only a small amount of material which is retained in the dispensing tube during periods of non dispensing which due to the compressible character of e.g. ice-cream can lead to post-expansion and hence unwanted dripping; to compensate for this post-expansion the suck-back action is applied. The smaller the necessary suck-back, the better the accuracy in dosing.

The described device is easy to clean and can be re-assembled within a short time. Spare parts can easily be made and installed.

What is claimed is:

1. Method for the dosing of viscous products using a dispensing device comprising;
   - a dosing chamber having an inlet and an outlet;
   - a dispensing outlet having a first end and a second end said dispensing outlet situated at the outlet of the dosing chamber;
   - means attached to the first end of the dispensing outlet for substantially vertically moving said outlet;
   - a supply conduit attached to the inlet of said dosing chamber;
   - a valve for said supply conduit comprising the inlet of the dosing chamber and means attached to the first end of the dispensing outlet for substantially vertically moving said outlet and
   - a dispensing valve separating the outlet of the dosing chamber from the dispensing outlet;
   - the movements of the components of the apparatus being controllable, comprising the steps of
   - (a) downwardly moving the dispensing outlet while the supply valve is open and the dispensing valve is closed, thereby increasing the volume of the dosing chamber and filling the dosing chamber with viscous product
   - (b) closing the supply valve
   - (c) opening the dispensing valve
   - (d) upwardly moving the dispensing outlet, thereby decreasing the volume of the dosing chamber and ejecting the viscous product from the dosing chamber
   - (e) closing the dispensing valve
   - (f) opening the supply valve.

2. Method according to claim 1 further comprising the step of sucking back at least part of the viscous material, which is left in the dispensing outlet after dispensing, into the dosing chamber.

3. Method according to claim 1 wherein the volume of viscous product ejected by the dosing chamber is variable.

4. Apparatus for volumetric dosing of viscous products comprising;
   - a dosing chamber of variable volume having an inlet and an outlet;
   - a dispensing outlet having a first end and a second end said dispensing outlet situated at the outlet of the dosing chamber;
   - means attached to the first end of the dispensing outlet for substantially vertically moving said outlet;
   - a supply conduit attached to the inlet of said dosing chamber;
   - a valve for said supply conduit comprising the inlet of the dosing chamber and means attached to the first end of the dispensing outlet for substantially vertically moving said outlet and a dispensing valve separating the outlet of the dosing chamber from the dispensing outlet;

whereby the movements of the components of the apparatus are controllable, the upward movement of the dispensing outlet whilst the valve for the supply conduit is closed causing ejection of the viscous product from the dosing chamber through the dispensing outlet, and downward movement of the dispensing outlet whilst the valve for the supply conduit is open and the dispensing valve is closed allows the dosing chamber to be refilled-with viscous product.

5. Apparatus according to claim 4 having a housing for vertically guiding the movement of the dispensing outlet.

6. Apparatus according to claim 5 wherein the housing also guides the closing and opening of the outlet valve.

7. Apparatus according to claim 5 wherein the housing also guides the closing and opening of the supply valve.

8. Apparatus according to claim 6 wherein the housing also guides the closing and opening of the supply valve.

* * * * *